US006283709B1

(12) United States Patent
Hill et al.

(10) Patent No.: US 6,283,709 B1
(45) Date of Patent: Sep. 4, 2001

(54) VARIABLE POSITION FAN ASSEMBLY

(75) Inventors: D. Lee Hill, Olean, NY (US); Jimmy D. Vanfossan, deceased, late of Gladstone, MO (US), by Carolyn Vanfossan, Legal Representative

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/184,364

(22) Filed: Nov. 2, 1998

(51) Int. Cl.[7] ..... F01D 7/00

(52) U.S. Cl. ..... 416/110; 416/100; 416/61; 416/108; 416/246; 454/338

(58) Field of Search ..... 416/100, 61, 108, 416/130, 110, 98, 246; 248/651, 652, 653, 654; 454/338

(56) References Cited

U.S. PATENT DOCUMENTS

| | | | |
|---|---|---|---|
| Re. 34,551 | 2/1994 | Coup et al. | 415/121.5 |
| D. 309,944 | 8/1990 | Chiu | D23/382 |
| 515,405 | 2/1894 | Meston . | |
| 521,114 | 6/1894 | Hobbs . | |
| 537,087 | 4/1895 | Travis . | |
| 550,107 | 11/1895 | Longauer . | |
| 652,241 | 6/1900 | Bourquin . | |
| 672,303 | 4/1901 | Williams | 416/246 |
| 751,485 | 2/1904 | Eck | 416/246 |
| 1,055,947 | 3/1913 | Schwartzberg . | |
| 1,114,459 | 10/1914 | Fritts . | |
| 1,194,413 | 8/1916 | Nesseler . | |
| 1,423,717 | 7/1922 | Hicks . | |
| 1,432,710 | 10/1922 | Macmechen . | |
| 1,597,871 | 8/1926 | Reynders | 416/246 |
| 1,670,056 | 5/1928 | Winters | 416/246 |
| 1,793,814 | 2/1931 | McCaig . | |
| 1,809,583 | 6/1931 | Cook . | |
| 1,971,332 | 8/1934 | Cook | 230/275 |
| 2,017,431 | 10/1935 | Anderson et al. | 230/275 |
| 2,036,478 | 4/1936 | Hoff et al. | 230/275 |
| 2,054,383 | 9/1936 | Ludewig | 170/62 |
| 2,063,874 * | 12/1936 | Hodge | 416/130 |
| 2,116,849 | 5/1938 | Rosner | 115/0.5 |
| 2,207,948 | 7/1940 | Sheridan | 170/159 |
| 2,215,035 | 9/1940 | Gundelfinger | 230/273 |
| 2,259,853 | 10/1941 | Koch | 230/274 |
| 2,288,592 | 7/1942 | Mirhige | 15/247 |
| 2,345,516 | 3/1944 | Weber | 230/275 |
| 2,498,968 | 2/1950 | Viewegh | 230/275 |
| 2,617,583 | 11/1952 | Kemler | 230/275 |
| 2,624,504 | 1/1953 | Viewegh | 230/275 |
| 2,652,974 | 9/1953 | Fettel | 416/246 |
| 2,653,757 | 9/1953 | Segalman | 230/274 |
| 2,658,666 | 11/1953 | Krzesiewski | 230/259 |
| 2,728,519 | 12/1955 | McLarty | 230/259 |
| 2,862,657 | 12/1958 | Copeland et al. | 230/273 |
| 2,990,889 | 7/1961 | Welch | 170/170 |
| 3,072,321 * | 1/1963 | King, Jr. | 416/100 |

(List continued on next page.)

FOREIGN PATENT DOCUMENTS 59-58199 * 4/1984 (JP) .

*Primary Examiner*—Edward K. Look
*Assistant Examiner*—Richard Woo
(74) *Attorney, Agent, or Firm*—Hovey, Williams, Timmons & Collins

(57) ABSTRACT

An electric fan mounted overhead for universal adjustment of the air flow direction. A mounting plate clamped to an overhead beam carries a sleeve that rotatively receives a vertical column. The lower end of the column pivotally connects with a mounting arm which carries the fan. A rotation motor can rotationally adjust the column to adjust the lateral direction in which the fan faces. A linear actuator pivots the mounting arm up and down to adjust the tilt angle of the fan.

28 Claims, 1 Drawing Sheet

U.S. PATENT DOCUMENTS

| | | | | |
|---|---|---|---|---|
| 3,262,638 | | 7/1966 | Militello | 230/275 |
| 3,402,882 | | 9/1968 | Militello | 230/275 |
| 3,414,121 | | 12/1968 | Suzuki | 206/46 |
| 3,446,429 | | 5/1969 | Suzuki et al. | 230/259 |
| 3,725,640 | | 4/1973 | Kunz | 219/370 |
| 3,787,142 | | 1/1974 | Dupke | 416/247 |
| 3,791,333 | | 2/1974 | Losch | 115/34 R |
| 3,792,782 | * | 2/1974 | Melton | 414/741 |
| 3,963,382 | | 6/1976 | Patton | 417/361 |
| 3,971,199 | | 7/1976 | Buchele | 56/320.2 |
| 4,022,548 | | 5/1977 | McLarty | 416/247 R |
| 4,120,615 | | 10/1978 | Keem et al. | 417/360 |
| 4,242,046 | | 12/1980 | Matucheski et al. | 416/132 |
| 4,285,637 | | 8/1981 | Thompson | 416/202 |
| 4,319,866 | | 3/1982 | Kolthoff | 416/210 R |
| 4,439,108 | | 3/1984 | Will | 416/131 |
| 4,517,481 | | 5/1985 | Breining | 310/71 |
| 4,618,313 | | 10/1986 | Mosiewicz | 416/237 |
| 4,657,478 | | 4/1987 | LaZebnik et al. | 415/126 |
| 4,657,485 | | 4/1987 | Hartwig | 416/247 |
| 4,662,823 | | 5/1987 | Cooke | 416/23 |
| 4,672,234 | | 6/1987 | Breining et al. | 307/147 |
| 4,676,721 | | 6/1987 | Hardee | 416/146 R |
| 4,732,539 | | 3/1988 | Shin-Chin | 416/100 |
| 4,815,934 | | 3/1989 | Rademaker | 415/191 |
| 4,818,183 | | 4/1989 | Schaefer | 416/247 |
| 4,819,370 | | 4/1989 | Woodruff | 43/113 |
| 4,832,572 | | 5/1989 | Prucha et al. | 416/146 R |
| 4,850,804 | | 7/1989 | Huang | 416/246 |
| 4,861,230 | | 8/1989 | Breining | 416/247 R |
| 4,863,351 | | 9/1989 | Fischer et al. | 416/203 |
| 4,892,460 | | 1/1990 | Volk | 416/62 |
| 4,953,698 | | 9/1990 | Gregorich et al. | 206/319 |
| 5,002,462 | | 3/1991 | Janisse | 416/247 |
| 5,073,088 | | 12/1991 | Peng | 416/247 |
| 5,193,984 | | 3/1993 | Lin | 416/247 R |
| 5,203,826 | | 4/1993 | Dalebout | 74/572 |
| 5,240,378 | | 8/1993 | Janisse et al. | 416/247 R |
| 5,246,343 | | 9/1993 | Windsor et al. | 416/210 R |
| 5,256,039 | * | 10/1993 | Crawford | 416/100 |
| 5,273,399 | | 12/1993 | Ojeda | 416/146 R |
| 5,281,093 | | 1/1994 | Sedlak et al. | 416/62 |
| 5,327,233 | | 7/1994 | Choi | 348/152 |
| 5,328,329 | | 7/1994 | Monroe | 416/62 |
| 5,352,094 | | 10/1994 | Peng | 416/247 R |
| 5,370,500 | * | 12/1994 | Thompson | 416/100 |
| 5,370,721 | | 12/1994 | Carnahan | 55/279 |
| 5,429,481 | | 7/1995 | Liu | 416/246 |
| 5,435,696 | | 7/1995 | Cunning | 416/246 |
| 5,462,411 | | 10/1995 | Bianchi | 416/202 |
| 5,474,427 | | 12/1995 | Redetzke | 416/247 R |
| 5,516,264 | | 5/1996 | Anetrini | 416/62 |
| 5,522,704 | | 6/1996 | Casteel | 416/246 |
| 5,558,501 | | 9/1996 | Wang et al. | 416/244 R |
| 5,613,833 | | 3/1997 | Wolfe et al. | 416/246 |

* cited by examiner

VARIABLE POSITION FAN ASSEMBLY

FIELD OF THE INVENTION

This invention relates generally to electric fans and more particularly to an overhead fan that is mounted in a manner to provide adjustment of the fan position in order to circulate air as desired.

BACKGROUND OF THE INVENTION

Electric fans provide ventilation in a wide variety of industrial and commercial applications. It is common in many factories and other facilities for an overhead fan to be provided for each different work area in order to circulate air in the work areas. Typically, the fan is mounted in a fixed overhead position to direct air generally downwardly toward workers at each work station. While this is often satisfactory, it is at times ineffective because the worker or workers in the vicinity may be located out of the path of the air flow where they do not receive its benefits. The productivity of workers can suffer as a consequence. Also, each work station requires a dedicated fan which results in the need for a large number of fans and a relatively high cost.

SUMMARY OF THE INVENTION

The present invention is directed to an overhead fan which is installed to allow adjustment of its position in order to overcome the problems associated with fixed fans. In particular, the direction of air flow can be varied as desired to circulate the air where it is needed at any given time. It is a particular feature of the invention that the fan position is adjusted by power driven systems so that manual adjustments are not required. The number of fans required in a factory or other facility is minimized because the adjustment allows each fan to cover a relatively wide area.

In accordance with the invention, an overhead electric fan can be mounted to an overhead structure such as an I-beam or T-beam. The mounting structure for the fan includes a plate which can be clamped to the beam using a conventional clamp bracket. The plate carries a vertical sleeve which is reinforced by an angled brace. A column is supported to turn in the sleeve and can be selectively adjusted in its rotative position by a motor that acts through a gear train.

The fan is carried on the outer end of a mounting arm having its opposite end pivoted to the bottom of the vertical column. A linear actuator mechanism serves to pivot the arm up and down in order to tilt the fan up and down. The rotational adjustment provided by the column allows the fan to be aimed as desired about the vertical axis of the column. Thus, the mounting arrangement and controls allow the fan to be aimed in any direction laterally and to be tilted to any desired downward angle in order to direct air to the area where it is needed at any particular time. The controls are power operated and can be controlled remotely so that adjustment of the fan position can be made quickly and easily without the need for manual adjustments that can unduly occupy the time and attention of workers. Consequently, the fan of the present invention allows ventilating air to be accurately directed as desired and increases the productivity of workers.

The present invention is also characterized by the provision of a structurally sound mounting system that makes use of readily available components. As a result, the structural integrity of the fan installation is assured and the component costs are minimized. In addition, repair and replacement of parts are quickly, easily and economically carried out when necessary.

BRIEF DESCRIPTION OF THE DRAWINGS

In the accompanying drawing which forms a part of the specification and is to be read in conjunction therewith.

DETAILED DESCRIPTION OF THE INVENTION

Figure 1:
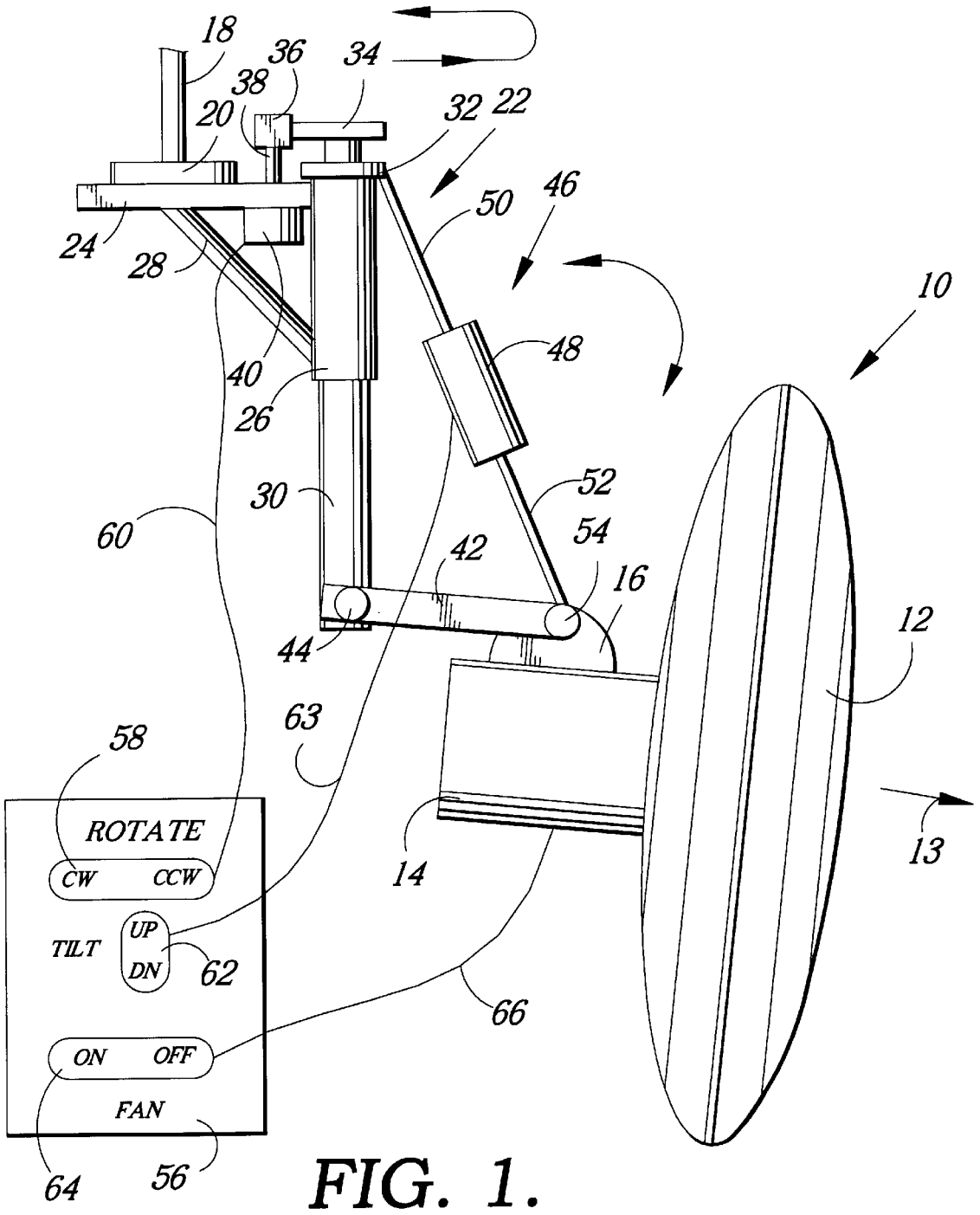
FIG. 1 is a diagrammatic side elevational view of a variable position electric fan which is installed at an overhead position through the use of a mounting structure constructed in accordance with a preferred embodiment of the present invention.

With reference to the drawing in more detail, reference numeral 10 generally designates a conventional electric fan having a cage 12 which encloses a conventional fan impeller (not shown). The impeller is rotated by an electric motor 14 to circulate air in the general direction indicated by the directional arrow 13. The top of the motor 14 is provided with a lug 16 which provides for mounting of the fan 10, as will be described.

The fan 10 is mounted to an overhead structure such as an overhead beam 18 forming part of the framing structure of a building and having a horizontal bottom flange 20. The fan has a rigid mounting frame which is generally identified by numeral 22 and which includes a flat mounting plate 24. The mounting plate 24 is equipped with a conventional clamp bracket which can be clamped to the flange 20 in order to rigidly secure the mounting plate 24 to the bottom of the beam 18.

A hollow cylindrical sleeve 26 is welded or otherwise secured to one end of the mounting plate 24. The top end of the sleeve 26 is located at or near the level of the mounting plate 24, and the sleeve extends downwardly to a location well below plate 24. An angled brace 28 connects at its upper end with the underside of the mounting plate 24 and at its lower end with the side of sleeve 26 near the bottom end of the sleeve. The brace 28 thus forms a triangular structure with the plate 24 and sleeve 26 in order to provide the frame 22 with structural integrity and stability.

A vertical column 30 extends through the sleeve 26 and is axially rotatable about the central vertical axis of the column 30. The column 30 is cylindrical and is equipped with a bearing flange 32 near its top end which overlies and bears on the top end of the sleeve 26. Above the flange 32, the column 30 carries a gear 34 which is mated with and driven by a smaller gear 36. Gear 36 is carried on the top end of a rotary output shaft 38 driven by an electric motor 40. The shaft 38 is parallel to the column 30, and the motor 40 is suitably mounted to the underside of the mounting plate 24. The motor 40 may be a reversible electric motor that can drive the column 30 through gears 34 and 36 in opposite rotational directions.

The mounting arrangement for the fan 10 includes a mounting arm 42 having one end pivoted at 44 with the bottom end of the column 30 at a location well below the sleeve 26. The lug 16 of the fan motor 14 is secured to the opposite or outer end of the mounting arm 42 such that the fan is carried on the arm. The pivot coupling 44 provides a horizontal axis about which arm 42 can be pivoted up and down.

The arm 42 can be pivoted about the horizontal axis of its pivot connection 44 by a linear actuator mechanism which is generally identified by numeral 46. The actuator mechanism 46 includes a linear actuator motor 48 which connects with an upper rod 50 and a lower rod 52. The upper rod 50 is pivotally connected with the bearing flange 32 at its top end and is connected with the actuator motor 48 at its bottom end. The other rod 52 is an extensible and retractable rod which extends from the motor 48 and is pivotally connected at 54 with the outer end of the mounting arm 42. The motor 48 can be operated to extend and retract rod 52 in order to vary the overall length of the actuator mechanism 46 between the ends of the two rods 50 and 52. When the rod 52 is extended, the fan 10 is tilted downwardly about the pivot coupling 44 due to the downward pivotal movement of arm 42. Conversely, when rod 52 is retracted, the fan 10 is tilted upwardly due to the raising of the mounting arm 42 about coupling 44.

The fan motor 14, rotation motor 40 and linear actuator 48 can be controlled by any suitable type of control system. For example, wall mounted switches (not shown) may be provided for controlling these motors, and the motors may be hard wired to the building power supply through the switches.

However, the motors are preferably remotely controlled by a device such as the remote control unit 56 shown in FIG. 1. The remote control unit 56 may be a hand held device that controls the motors through radio optical (or other wireless) signals. The remote control unit 56 may have a control switch 58 for the rotational motor 40. The switch 58 may be a rocker switch which acts through a radio signal 60 to rotate column 30 in one direction ("CW" or clockwise) when depressed at one end and in the opposite rotative direction ("CCW" or counterclockwise) when depressed at the other end. Similarly, a rocker 62 for the linear actuator motor may be depressed at one end ("UP") to retract the rod 52 in order to tilt fan 10 upwardly and at the opposite end ("DN" or down) to extend rod 52 and thus tilt the fan 10 downwardly. Numeral 63 diagrammatically indicates a radio signal used for controlling the linear actuator motor 48 in this fashion. Finally, another switch 64 may be depressed at one end to energize the fan motor 14 and at the opposite end to deenergize the fan motor 14. Numeral 66 diagrammatically shows a radio signal used for this purpose. Other types of controls and switches can be used within the scope of the invention.

In operation, the fan motor 14 may be energized and deenergized through switch 64 or some other control, and the fan may be a variable speed fan having different speed settings or continuously variable speed settings. Known types of controls can be provided to control the fan speed (preferably remotely). If it is desired to change the direction of the air flow, the switches 58 and 62 can be operated as desired to swing the fan about the vertical axis of the rotating column 30 in order to direct the air in the desired lateral direction and/or to tilt the fan up or down about pivot coupling 44 to achieve the desired tilt angle.

By providing the fan 10 with a mounting arrangement which allows universal adjustment of the fan and by providing power operated controls, worker productivity can be increased substantially. The circulation path of the air provided by the fan can be quickly and easily adjusted to accommodate workers in the vicinity, and the power operated nature of the adjustments avoids the disincentive to adjustment of the fan that is provided by adjustments that must be made manually. Similarly, the rapid adjustment of the fan position that can be made avoids distracting the workers' attention from their work and eliminates need to take time away from their work to carry out mechanical adjustments. By providing both rotational adjustment and up and down tilting adjustment, the fan can be directed to circulate air through a wide area and in virtually any direction.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A fan assembly for attachment to an overhead structural member, comprising:

a motor driven fan;

a mounting frame applicable to said structural member to connect said frame thereto;

a rotary connection between said fan and said frame supporting said fan on said frame for turning movement about a substantially vertical axis;

a drive system arranged to selectively turn said fan about said vertical axis;

a pivot connection between said fan and said frame allowing the fan to pivot about a substantially horizontal axis; and a power actuator operable to pivot said fan about said horizontal axis.

2. A fan assembly as set forth in claim 1, wherein said rotary connection comprises:

a sleeve rigidly connected with said frame; and a substantially vertical column carrying said fan and extending through said sleeve, said column being rotatable in said sleeve to turn said fan about said vertical axis.

3. A fan assembly as set forth in claim 2, wherein said drive system comprises:

a motor mounted on said frame and having a rotary output shaft; and a drive train connecting said shaft with said column in a manner to turn the column upon rotation of said shaft by the motor.

4. A fan assembly as set forth in claim 1, including a remote control unit operable to apply wireless control signals for controlling said drive system and actuator.

5. An overhead fan installation comprising:

a motor driven fan;

an overhead structural member;

a mounting frame secured to said structural member;

a column mounted to said frame for axial rotation about a substantially vertical axis;

a drive system arranged to selectively rotate said column about said vertical axis;

a pivot connection between said fan and said column allowing the fan to pivot on the column about a substantially horizontal axis; and a power actuator operable to selectively pivot said fan about said horizontal axis.

6. A fan installation as set forth in claim 5, including a remote control unit operable to apply wireless signals to said drive system and actuator for control thereof.

7. A fan installation as set forth in claim 5, wherein said drive system comprises:

a motor mounted on said frame and having a rotary output shaft; and a drive train connecting said shaft with said column in a manner to turn the column upon rotation of said shaft by the motor.

8. An adjustable fan assembly for mounting on an overhead structural member, comprising:

a motor driven fan;

a mounting frame including a rigid plate adapted for attachment to said structural member and a sleeve secured to said plate;

a column extending through said sleeve and mounted thereto for axial rotation about an axis that is substantially vertical when the plate is attached to the structural member, said column having upper and lower end portions;

a drive system drivingly coupled with the upper end portion of said column and operable to rotate said column about said vertical axis;

a mounting arm having a first end carrying said fan and a second end coupled with the lower end portion of said column for pivotal movement thereon about a substantially horizontal axis; and a power actuator operable to pivot said arm about said horizontal axis.

9. A fan assembly as set forth in claim 8, wherein said power actuator comprises:

a linear actuator mechanism having one end connected with said column and another end connected with said arm at a location offset from said second end thereof, said actuator being extensible and retractable to pivot said arm about said second end thereof.

10. A fan assembly as set forth in claim 9, wherein said drive system comprises:

a motor mounted on said plate and having a rotary output shaft; and a drive train connecting said shaft with said column in a manner to turn the column upon rotation of said shaft by the motor.

11. A fan assembly as set forth in claim 8, wherein said drive system comprises:

a motor mounted on said plate and having a rotary output shaft; and a drive train connecting said shaft with said column in a manner to turn the column upon rotation of said shaft by the motor.

12. A fan assembly as set forth in claim 8, wherein said frame includes an angled brace extending rigidly between said plate and said sleeve.

13. A fan assembly for attachment to an overhead structural member, comprising:

a motor driven fan;

a mounting frame applicable to said structural member to connect said frame thereto;

a rotary connection between said fan and said frame supporting said fan on said frame for turning movement about a substantially vertical axis, said rotary connection including:

a sleeve rigidly connected with said frame; and a substantially vertical column carrying said fan and extending through said sleeve, said column being rotatable in said sleeve to turn said fan about said vertical axis;

a drive system arranged to selectively turn said fan about said vertical axis;

a pivot connection between said fan and said frame allowing the fan to pivot about a substantially horizontal axis, wherein said pivot connection includes a mounting arm having a first end carrying said fan and a second end pivotally connected with said column to pivot about said horizontal axis; and a power actuator operable to pivot said fan about said horizontal axis.

14. A fan assembly as set forth in claim 13, wherein said power actuator comprises:

a linear actuator mechanism having one end connected with said column and another end connected with said arm at a location offset from said second end thereof, said actuator being extensible and retractable to pivot said arm about said second end thereof.

15. A fan assembly for attachment to an overhead structural member, comprising:

a motor driven fan;

a mounting frame applicable to said structural member to connect said frame thereto;

a rotary connection between said fan and said frame supporting said fan on said frame for turning movement about a substantially vertical axis;

a drive system arranged to selectively turn said fan about said vertical axis;

a pivot connection between said fan and said frame allowing the fan to pivot about a substantially horizontal axis, wherein said pivot connection includes a mounting arm having a first end carrying said fan and a second end pivotally connected with said frame to pivot about said horizontal axis; and a power actuator operable to pivot said fan about said horizontal axis.

16. A fan assembly as set forth in claim 15, wherein said power actuator comprises:

a linear actuator having one end connected with said frame and another end connected in the said arm at a location offset from said second end thereof, said actuator being extensible and retractable to pivot said arm about said second end thereof.

17. An overhead fan installation comprising:

a motor driven fan;

an overhead structural member;

a mounting frame secured to said structural member;

a column mounted to said frame for axial rotation about a substantially vertical axis;

a drive system arranged to selectively rotate said column about said vertical axis;

a pivot connection between said fan and said column allowing the fan to pivot on the column about a substantially horizontal axis, wherein said pivot connection including a mounting arm having a first end carrying said fan and a second end pivotally connected with said column to pivot about said horizontal axis; and a power actuator operable to selectively pivot said fan about said horizontal axis.

18. A fan installation as set forth in claim 17, wherein said power actuator comprises:

a linear actuator mechanism having one end connected with said column and another end connected with said arm at a location offset from said second end thereof, said actuator being extensible and retractable to pivot said arm about said second end thereof.

19. A fan installation as set forth in claim 18, wherein said drive system comprises:

a motor mounted on said frame and having a rotary output shaft; and a drive train connecting said shaft with said column in a manner to turn the column upon rotation of said shaft by the motor.

20. A fan installation as set forth in claim 17, wherein said drive system comprises:

a motor mounted on said frame and having a rotary output shaft; and a drive train connecting said shaft with said column in a manner to turn the column upon rotation of said shaft by the motor.

21. A fan assembly, comprising:

a motor driven fan:

a mounting portion, wherein said fan is rotatable relative to said mounting portion about both a substantially horizontal axis and a substantially vertical axis;

at least one motor for permitting said horizontal and vertical rotation;

a control unit located remotely from said fan, said control unit adapted to operate said rotation motor;

a first rotation motor for permitting rotation about the substantially horizontal axis; and a second rotation motor for permitting rotation about the substantially vertical axis.

22. The fan assembly as set forth in claim 21, wherein said mounting portion is adapted to be attached to an overhead structural member.

23. The fan assembly as set forth in claim 21, wherein said control unit is hardwired to said rotation motor.

24. The fan assembly as set forth in claim 21, wherein said control unit is operable to transmit wireless control signals for controlling said rotation motor.

25. A fan assembly for attachment to an overhead structural member, comprising:

a fan, said fan having a rotor and a motor coupled to said rotor;

a mounting structure, said mounting structure adapted for attaching said fan to the overhead structural member;

a linkage assembly coupled between said fan and said mounting structure, wherein said linkage assembly is adapted to provide movement of said fan about each of a substantially horizontal axis and a substantially vertical axis;

a first powering device for selectively providing movement of the fan about the substantially horizontal axis; and a second powering device for selectively providing movement of the fan about the substantially vertical axis.

26. The fan assembly as set forth in claim 25, further comprising at least one motor coupled to said linkage assembly, said motor adapted to provide rotation of said fan about each of the horizontal and vertical axes.

27. The fan assembly as set forth in claim 26, further comprising a control unit located remotely from said fan, said control unit adapted to operate said rotation motor.

28. A fan assembly, comprising:

a motor driven fan;

a mounting portion, wherein said fan is rotatable relative to said mounting portion about a substantially horizontal axis and a substantially vertical axis to a selected, fixed position;

a first motor adapted to permit rotation of the fan about the substantially horizontal axis; and a second motor adapted to permit rotation of the fan about the substantially vertical axis.

* * * * *